US005651396A

United States Patent [19]

Yan et al.

[11] Patent Number: 5,651,396

[45] Date of Patent: Jul. 29, 1997

[54] VARIABLE PITCH LEAD TRANSMISSION MECHANISM FOR WEFT GRIPPER STRAP DRIVE

[75] Inventors: Hong-Sen Yan; Hong-Tih Cheng, both of Tainan, Taiwan

[73] Assignee: National Science Council, Taipei, Taiwan

[21] Appl. No.: 401,215

[22] Filed: Mar. 9, 1995

[51] Int. Cl.[6] ..... D03D 47/18

[52] U.S. Cl. ..... 139/449; 74/57; 74/89.15

[58] Field of Search ..... 74/59, 57, 89.15, 74/424.8 B; 139/449

[56] References Cited

U.S. PATENT DOCUMENTS

| | | | |
|---|---|---|---|
| 2,441,596 | 5/1948 | Reitter | 74/57 |
| 3,628,645 | 12/1971 | McFeaters | 74/57 X |
| 4,052,906 | 10/1977 | Genini | 139/449 X |
| 4,217,793 | 8/1980 | Abe | 74/89.15 |
| 4,454,931 | 6/1984 | Leiner et al. | 187/52 LC |
| 4,624,288 | 11/1986 | Pezzoli | 139/449 |
| 5,033,516 | 7/1991 | Debaes | 139/449 |
| 5,078,021 | 1/1992 | Freywiss | 74/57 |
| 5,320,143 | 6/1994 | Hwang et al. | 139/449 |
| 5,526,851 | 6/1996 | Hwang et al. | 139/449 |

*Primary Examiner*—Andy Falik
*Attorney, Agent, or Firm*—Ladas & Parry

[57] ABSTRACT

A variable pitch lead transmission mechanism includes a slider, a screw rod having a screw thread and two opposite screw thread surfaces and mounted on the slider, a driver contacting with one of the screw thread surfaces and adapted to be translated by a power source in order to in turn rotate the screw rod, and an elastic element mounted between the screw rod and the driver for providing a buffering action therebetween. Preferably, the buffer effect of the elastic element automatically accommodates the spin angle β of the driving base and the contact locations between the driver and the screw thread surface so as to avoid therebetween an adversely expanded clearance.

20 Claims, 8 Drawing Sheets

VARIABLE PITCH LEAD TRANSMISSION MECHANISM FOR WEFT GRIPPER STRAP DRIVE

FIELD OF THE INVENTION

The present invention relates to a transmission mechanism, especially to a transmission mechanism for shuttleless gripper looms, and more specifically to a transmission mechanism having variable pitch.

BACKGROUND OF THE INVENTION

Referring to FIG. 1, a textile 54 includes a large number of intensively mutually perpendicularly woven threads. The weaving work is completed with a plurality of pairs of vertically moving elements 5*a* and 5*b* for respectively carrying warps. On the one hand, two lateral controlling devices 51*a* and 51*b* respectively carry the two straps 42*a* and 42*b*. In one specific stroke, the left gripper 44*a* carries the weft 43 rightwardly to pass weft 43 to the right gripper 44*b* until the right gripper 44*b* reaches the right end. On the other hand, a weft insertion member 53 moves vertically to and fro along the warp direction to increase the closeness between two wefts 43.

In a control mechanism of a prior art loom as shown in FIG. 2, a linearly reciprocatingly moving slider 60 carries therewith a driver 63 to guidedly move along groove 62 of the screw rod 61. Mother prior art loom control mechanism as shown in FIG. 3 translates the fixed drivers 73 of a pair of driving bodies 74 along the screw thread 72 of the screw rod 71. But, as shown in FIGS. 2 & 3, the clearance between the driver 63 or 73 and the screw groove 62 or the screw thread 72 due to unavoidable manufacturing errors and/or the excessive preloaded pressure between the driver 63 or 73 and the screw rod 61 or 71 due to assembling errors may easily cause noise and tremendous vibration during the operation of the mechanism, which adversely wears away the operating surfaces of the drivers and the screw rods, and affects the textile quality and the working environment.

SUMMARY OF THE INVENTION

An object of the present invention is to provide a variable pitch lead transmission mechanism capable of self-accommodating according to the relative position between the screw thread and the driver thereof.

In accordance with the present invention, a variable pitch lead transmission mechanism comprises a slider, a screw rod having a screw thread with two opposite screw thread surfaces and mounted on the slider, a driver contacting one of the screw thread surfaces and adapted to be translated by a power source in order, in turn, to rotate the screw rod, and an elastic element mounted between the screw rod and the driver for providing a buffering action therebetween.

In further accordance with the present invention, the driver can include a shell, a driving body, and a cover plate attached to the shell for covering the driving body in the shell.

In further accordance with the present invention, the two ends of the elastic element can be bent and respectively retained on the driving body and the cover plate.

In accordance with the present invention, the driver further can include a bearing positioned between the shell and the driving body.

In accordance with the present invention, the driving body can further comprise an indentation. The cover plate further comprises a stopper corresponding to the indentation of the driving body. Further, the elastic element is mounted between the indentation and the stopper.

In further accordance with the present invention, the elastic element can be a spring.

In further accordance with the present invention, the elastic element can be a spiral spring.

In accordance with the present invention, the driving body can further include a mounting, a rod fixed to the mounting, and a truncated conical member held attached to the rod.

In accordance with the present invention, the driving body can further comprise a bearing mounted between the rod and the mounting.

In accordance with the present invention, the driving body can further comprise a second rod fixed to the mounting and a second truncated conical member held attached to the second rod.

In further accordance with the present invention, the screw thread can have a fixed pitch.

In further accordance with the present invention, the screw thread can have a variable pitch.

In accordance with the present invention, the slider can further comprise a transmission piece being externally driven by a power source.

In accordance with the present invention, the variable pitch lead transmission mechanism can further comprise a wheel mounted on one end of the screw rod and having a plurality of teeth for transmitting thereby an object.

In further accordance with the present invention, the transmitted object can be a weft.

In accordance with the present invention, the screw rod further comprises a second screw thread and the transmission mechanism further comprises a second driver, wherein the two drivers respectively contact the two screw threads.

In accordance with the preset invention, the transmission mechanism further comprises a second driver, wherein the two drivers contact the screw thread respectively at two different segments of the screw thread.

The present invention may best be understood from the following description with reference to the accompanying drawings, in which:

DETAILED DESCRIPTION OF THE PREFERRED EMBODIMENTS

Figure 4:
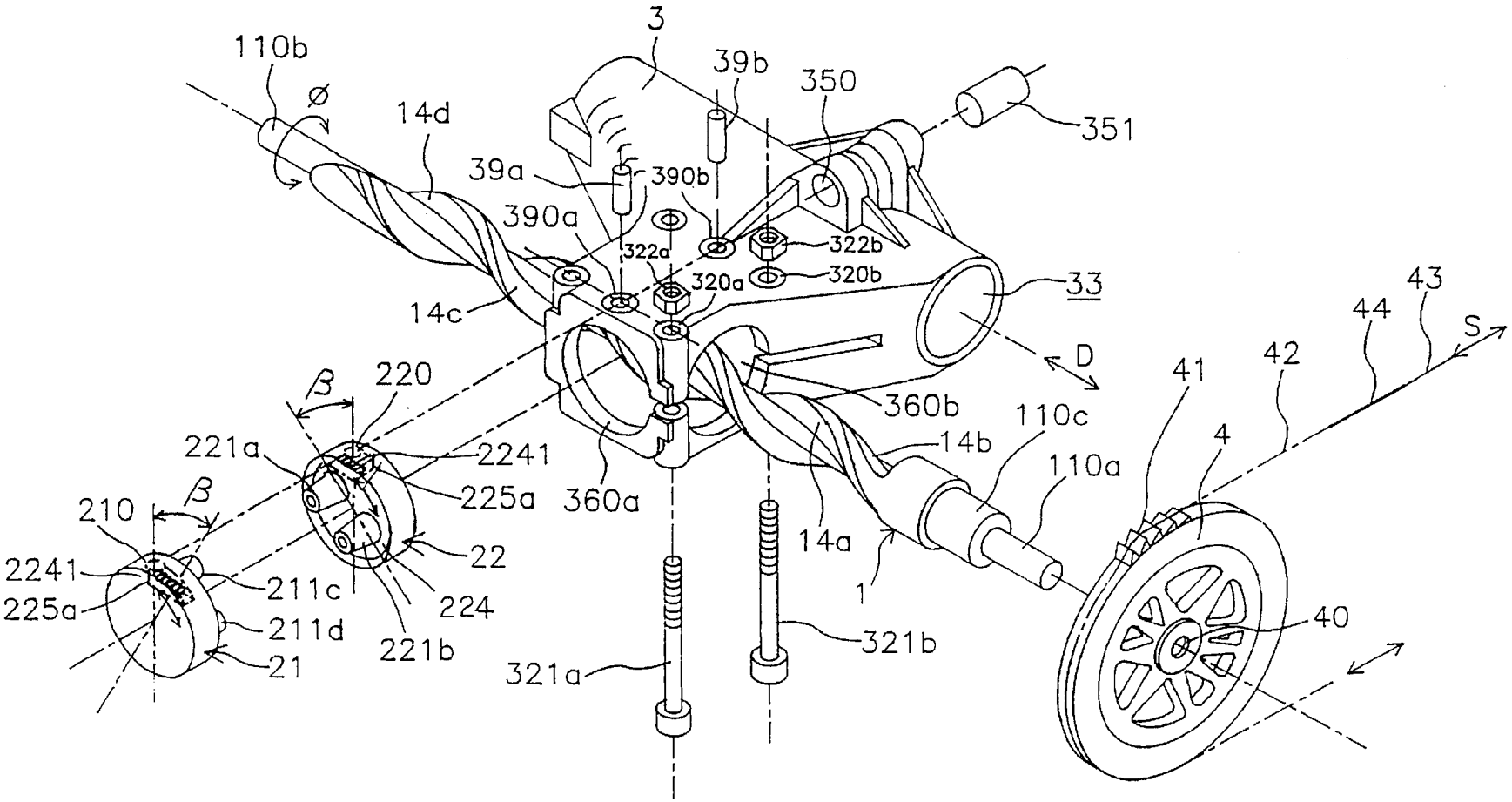
FIG. 4 is a schematic view showing disassembled parts of a variable pitch lead transmission mechanism having two screw threads according to a preferred embodiment of the present invention.

Referring to FIG. 4, a variable pitch lead transmission mechanism comprises a slider 3, a screw rod 1 having two screw threads and two sets of opposite screw thread surfaces 14*a*, 14*b* and 14*c*, 14*d* and mounted on the slider 3, two sets of truncated conical members 221*a*, 221*b* and 211*c*, 211*d* respectively contacting the four screw thread surfaces 14*a*, 14*b* and 14*c*, 14*d* and adapted to be translated by a power source in order, in turn, to rotate the screw rod 1. As also seen in FIGS. 5 & 6, respective elastic elements 225*a* and 225*b* are mounted in the driving body 224 for providing an elastic, buffering engagement of the truncated conical members 221*a*, 221*b* and 211*c*, 211*d* and the screw rod 1.

The slider 3 is driven by a transmission piece 351 inserted into a hole 350 in the slider 3 and the transmission piece 351 is adapted to be driven by a power source well known to one skilled in the art. The drivers 21 and 22 are respectively inserted into two holes 360*a* and 360*b* and are secured to the slider 3 by respectively inserting pins 39*a* and 39*b*' through respective positioning holes 210 and 220 in the drivers' 21 and 22 and holes 390*a* and 390*b* in the slider 3 and by threadedly engaging the corresponding screws 321*a* and 321*b* through another pair of positioning holes 320*a* and 320*b* of the slider 3 with nuts 322*a* and 322*b*. The two connecting lines of the two sets of truncated conical members 221*a*, 221*b* and 211*c*, 211*d* respectively cross their corresponding vertical axes at angles $\beta$ and $-\beta$. Preferably, the truncated conical members 221*a*, 221*b*, 211*c* and 211*d* respectively have surfaces conjugating with the screw thread surfaces 14*a*, 14*b* and 14*c*, 14*d*. Consequently, the drivers 21 and 22 will translate synchronously to and fro in the direction D with the slider 3 to conjugately drive the screw rod 1 to rotate, which in turn causes the rod ends 110*a* and 110*b* to rotate through angle $\phi$.

Figure 1:
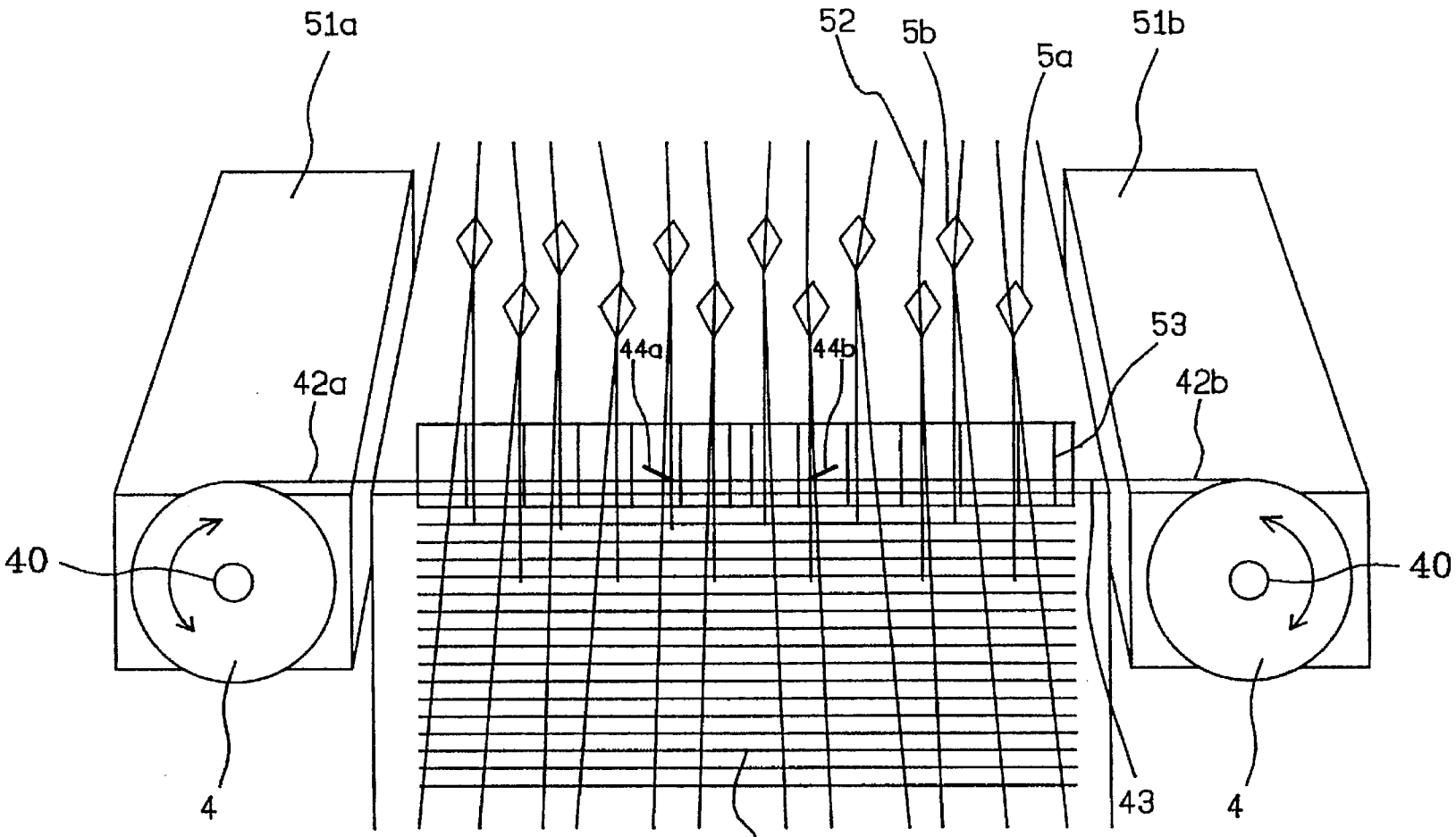
Fig. 1(PRIOR ART)
FIG. 1 is a schematic view showing an operation of a prior art shuttleless gripper loom.
Figure 2:
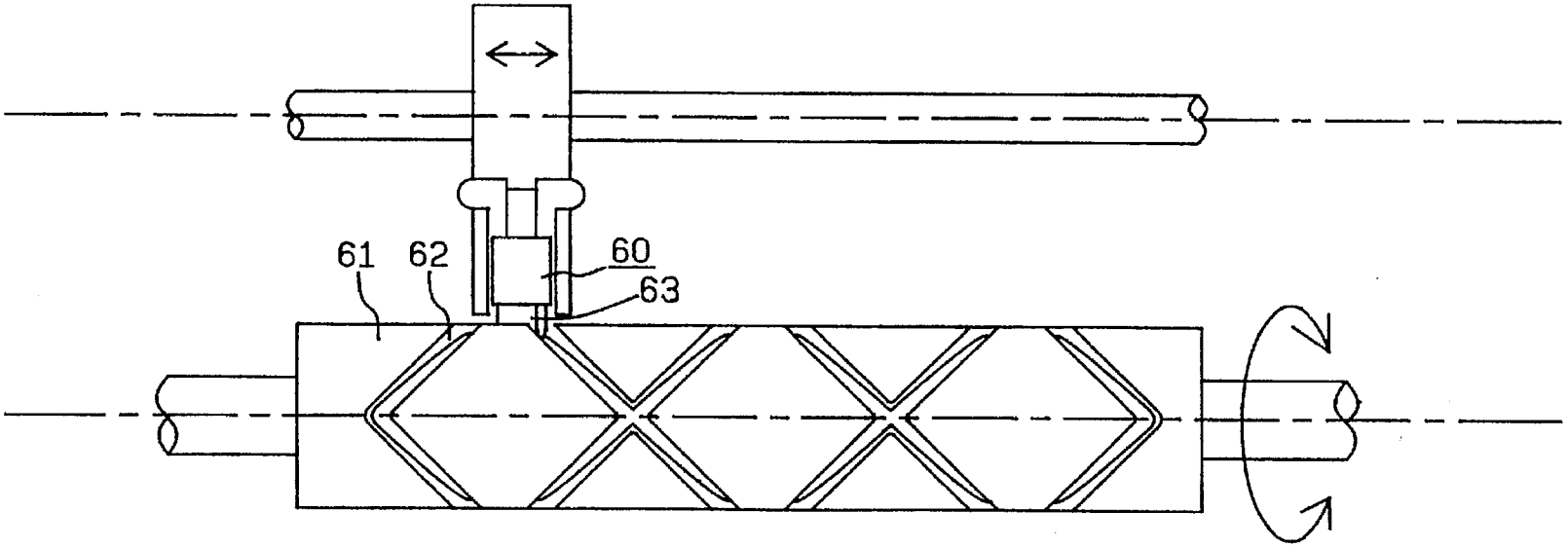
Fig. 2(PRIOR ART)
FIG. 2 is a schematic view showing a prior art transmission mechanism having a screw rod having a screw groove.
Figure 3:
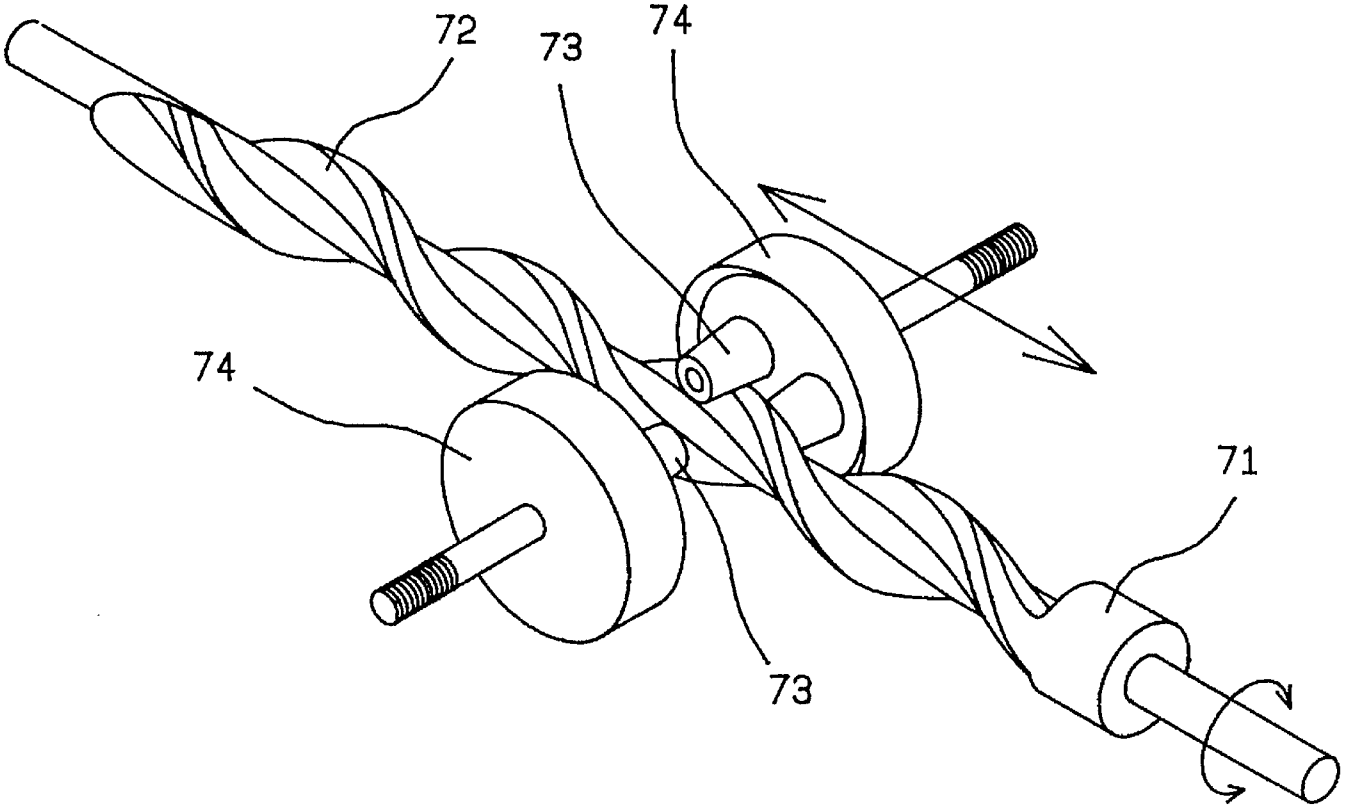
Fig. 3(PRIOR ART)
FIG. 3 is a schematic view showing a prior art transmission mechanism having a screw rod having a screw thread.

Further, the wheel 4 has a center hole 40 for securing therein the end segment 110*c* and the wheel 4 rotates synchronously with the ends 110*a* and 110*b*, which rotates the plurality of peripheral teeth 41 mounted on the wheel 4 to haul a strap 42 and a gripper 44 so as to carry a weft 43 to translate the weft in the direction S. In addition, a shuttleless gripper loom respectively includes two similar above-mentioned variable pitch lead transmission mechanisms located in the side cases 51*a* and 51*b* to complete the weft insertion, as shown in FIG. 1.

Figure 5:
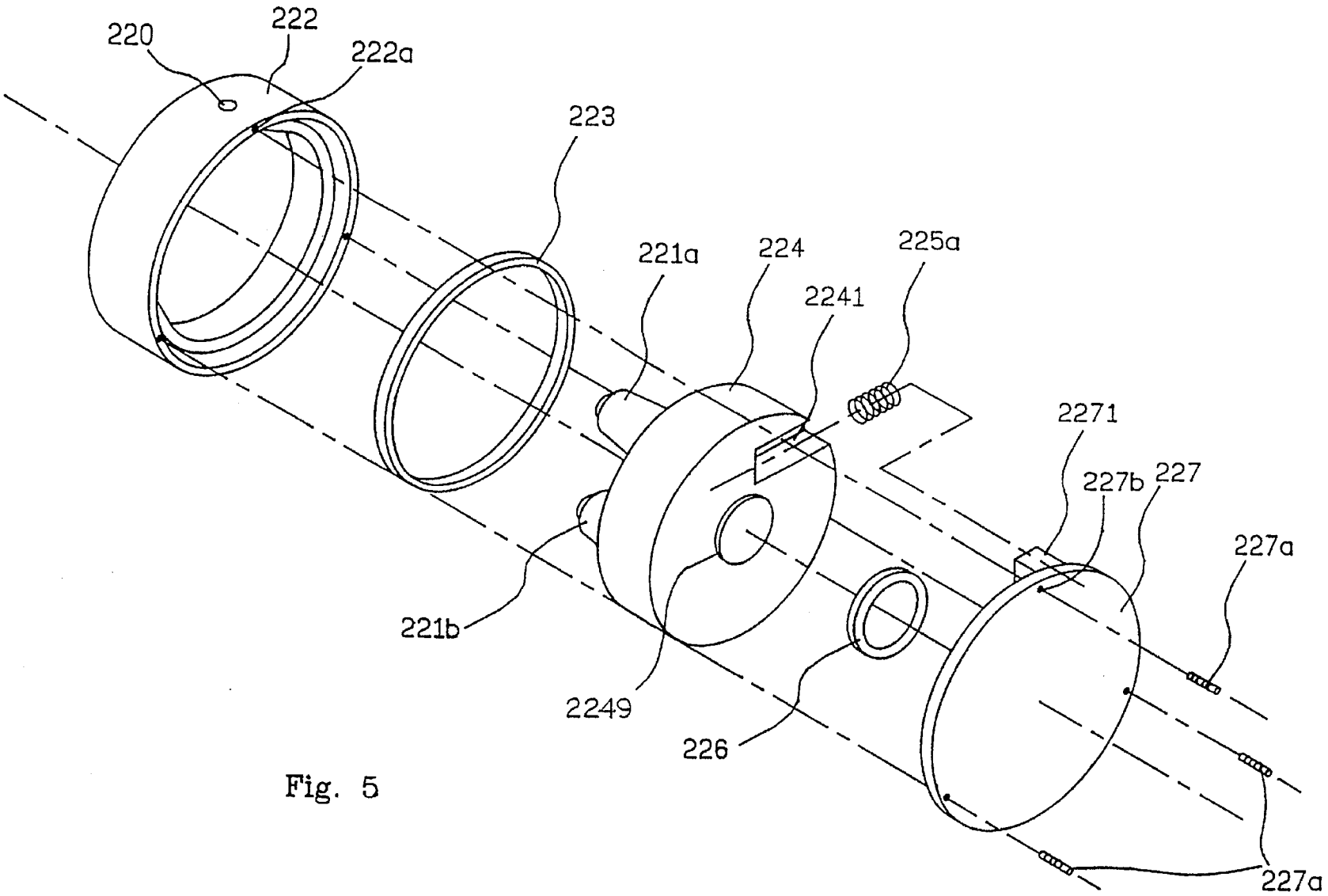
FIG. 5 is a schematic view showing a preferred embodiment of a driver with disassembled parts according to the present invention.
Figure 6:
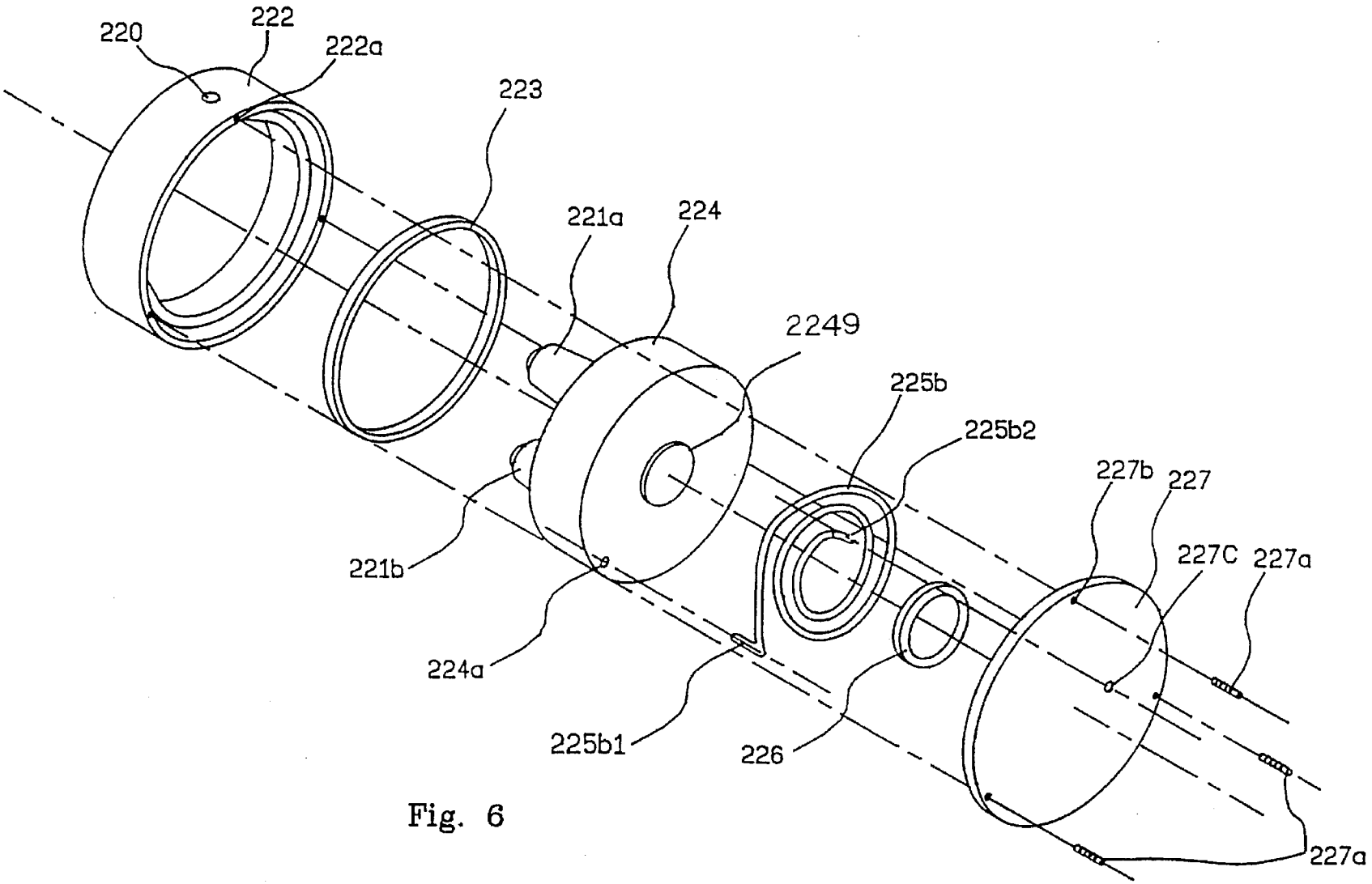
FIG. 6 is a schematic view showing another preferred embodiment of a driver with disassembled parts according to the present invention.

Referring to FIG. 5, the driver 21 or 22 includes a shell 222, two bearings 223 and 226, a driving body 224 and a cover plate 227. The driving body 224 has a protuberance 2249 on the one end for mounting bearing 226, and an indentation 2241 for mounting the elastic element 225*a* therein. The cover plate 227 is secured to the shell 222 with screws 227*a* through holes 227*b*. Thus, the driving body 224 can use the stopper 2271 protruding from the cover plate 227 and serving as a fulcrum to adjust the angle and the respective positions of the truncated conical members 221*a*, 221*b*, 211*c* and 211*d* inside the shell 222 to provide elastic, buffering engagement between the conical members of the drivers and the surfaces of the screw rod I. This, therefore, prevents tremendous vibration and noise, and greatly reduces the wear of the transmission mechanism.

Referring to FIG. 6, there is shown another preferred embodiment of the driver 21 or 22. The driving body 224 and the cover plate 227 have respectively holes 224*a* and 227*c* for mounting the two bent ends 255*b*1 and 255*b*2 of the spiral spring 225*b* so that the driving body 224 can use the cover plate 227 serving as a fulcrum to adjust the $\beta$ angle and the respective positions of the truncated conical members 221*a*, 221*b*, 211*c* and 211*d* inside the shell 222 and provide the buffering action between the rod 1 and the truncated conical members of the drivers.

Figure 7:
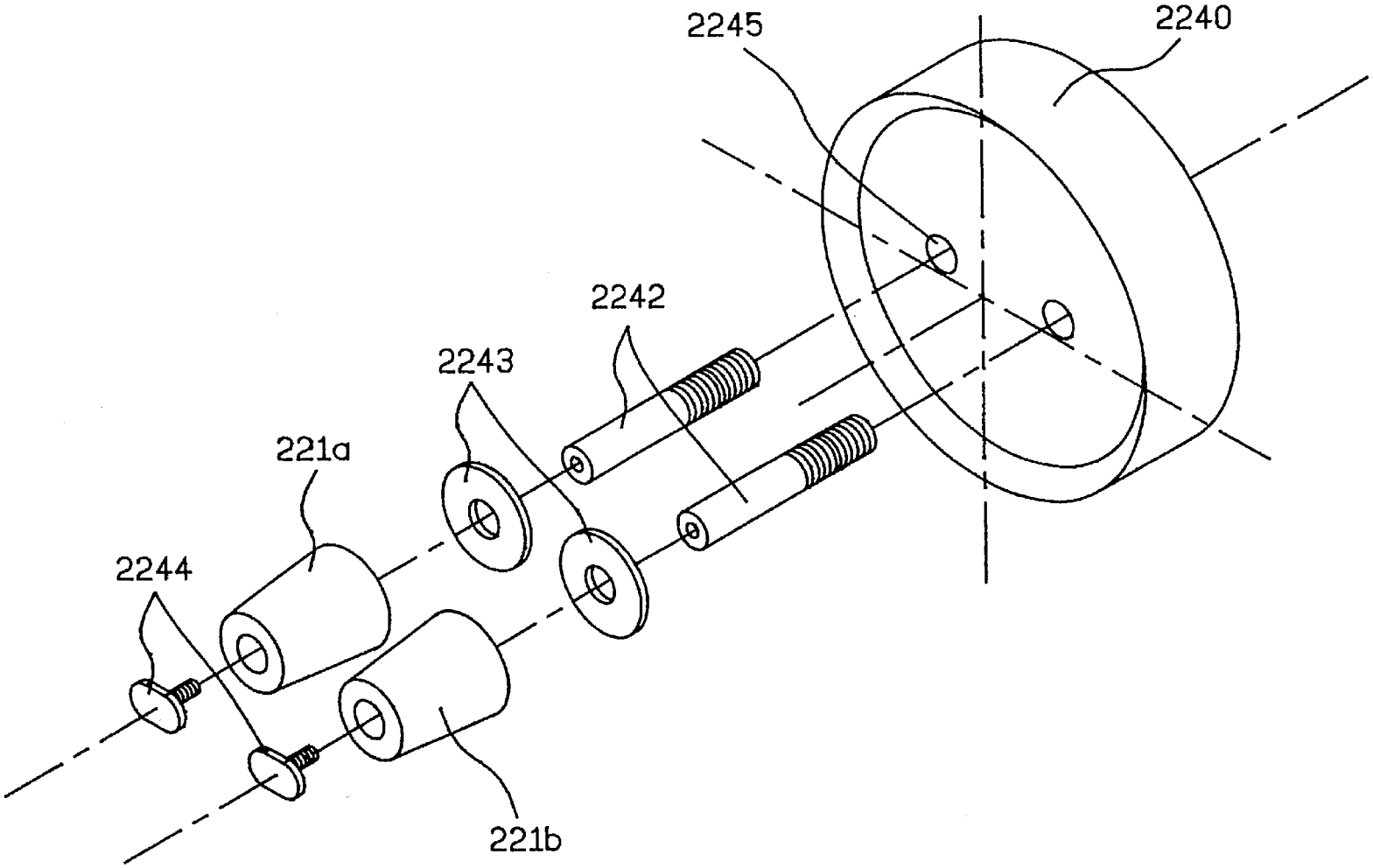
FIG. 7 is a schematic view showing a preferred embodiment of a driving body with disassembled parts according to the present invention.

Referring to FIG. 7, a preferred embodiment of the driving body 224, includes two truncated conical members 221*a* and 221*b*, two bearings 2243 mounted on first and second connection rods 2242 and respectively secured in the holes 2245 of the mounting 2240. Two screws 2244 are respectively secured at tips of the connection rods 2242 so as to confine the two truncated conical members 221*a* and 221*b* to rotate freely about first and second rods 2242 respectively.

Figure 8:
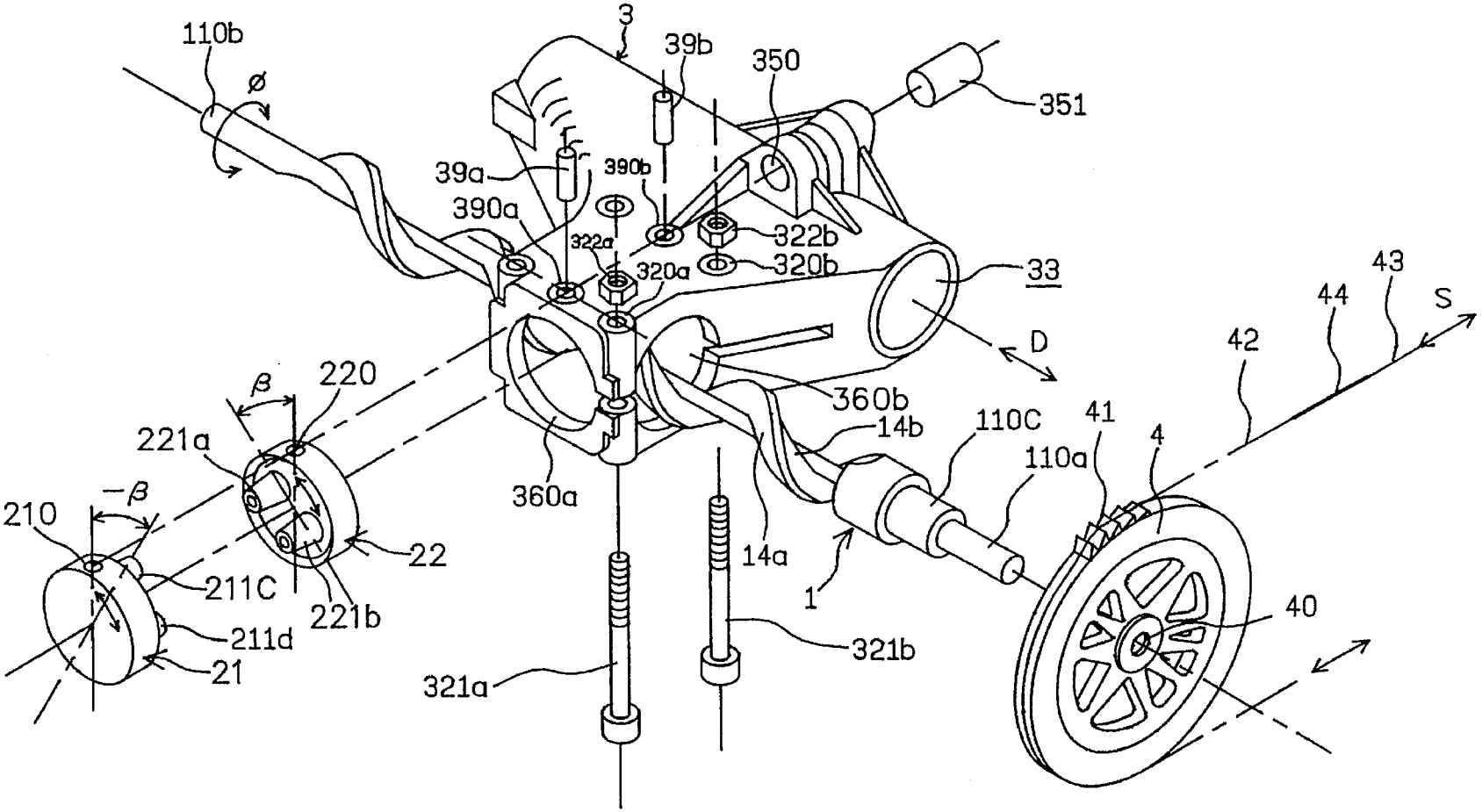
FIG. 8 is a schematic view showing disassembled parts of a variable pitch lead transmission mechanism having one screw thread according to another preferred embodiment of the present invention.

The present invention can not only convert an input of linear translation into an output of rotation, but also provide a function as a positive cam. The power source can be an oil pressure, a pneumatic source, and so on. Further, the outline of the truncated conical members 221*a*, 221*b*, 211*c* and 211*d* can be a sphere, a cylinder, an involute profile, a curved surface, and so forth. On the one hand, referring to FIG. 8, the screw rod 1 of a variable pitch lead transmission mechanism can have only one screw thread with two thread surfaces 14*a* and 14*b* and can be driven by two drivers 21 and 22, which is easily conceivable to one skilled in the art. On the other hand, the screw thread can also be replaced by a groove, and the screw thread or the groove of screw rod 1 can be more than one in number to correspond with the conical members of the driver 21(22) in order to decrease the respective loading of the driver 21(22).

While the invention has been described in terms of what are presently considered to be the most practical and preferred embodiments, it is to be understood that the invention need not be limited to the disclosed embodiments. On the contrary, it is intended to cover various modifications and similar arrangements included within the spirit and scope of the appended claims which are to be accorded the broadest interpretation so as to encompass all such modifications and similar structures.

What is claimed is:

1. A lead transmission mechanism comprising:

a slider;

a screw rod having a screw thread and two opposite screw thread surfaces, said slider being mounted on said screw rod and adapted to be translated thereon by a power source; and a driver secured to said slider and contacting one of said screw thread surfaces to rotate said screw rod when said slider is translated;

said driver including a shell secured to said slider, a driving body including a truncated conical member drivingly engaged with said one of said screw thread surfaces, a bearing positioned between said shell and said driving body, and an elastic element mounted between said shell and said driving body for providing an elastic, buffering action between said truncated, conical member and said screw rod.

2. A lead transmission mechanism according to claim 1, wherein said driver further includes;

a cover plate attached to said shell for covering said driving body in said shell.

3. A lead transmission mechanism according to claim 2, wherein two ends of said elastic element are bent and respectively retained on said driving body and said cover plate.

4. A lead transmission mechanism according to claim 2, wherein said driving body further comprises an indentation.

5. A lead transmission mechanism according to claim 4, wherein said cover plate further comprises a stopper corresponding to said indentation of said driving body.

6. A lead transmission mechanism according to claim 5, wherein said elastic element is mounted between said indentation and said stopper.

7. A lead transmission mechanism according to claim 6, wherein said elastic element is a spring.

8. A lead transmission mechanism according to claim 6, wherein said elastic element is a spiral spring.

9. A lead transmission mechanism according to claim 2, wherein said driving body further includes:

a mounting; and a connection rod fixed to said mounting;

said truncated conical member being rotatable on said connection rod.

10. A lead transmission mechanism according to claim 9, wherein said bearing is mounted on said connection rod and between said truncated conical member and said mounting.

11. A lead transmission mechanism according to claim 10, further comprising a second said connection rod fixed to said mounting and a second said truncated conical member secured to said second connection rod.

12. A lead transmission mechanism according to claim 1, wherein said screw thread has a fixed pitch.

13. A lead transmission mechanism according to claim 1, wherein said screw thread has a variable pitch.

14. A lead transmission mechanism according to claim 1, wherein said slider further comprises a transmission piece.

15. A lead transmission mechanism according to claim 1 further comprising a wheel mounted on one end of said screw rod and having a plurality of peripheral teeth for transmitting thereby an object.

16. A lead transmission mechanism according to claim 15, wherein said object is a weft.

17. A lead transmission mechanism according to claim 1, wherein said screw rod further comprises a second screw thread and said transmission mechanism further comprises a second driver, wherein said two drivers respectively contact said two screw threads.

18. A lead transmission mechanism according to claim 1, further comprising a second driver, wherein said two drivers respectively contact said screw thread.

19. A lead transmission mechanism comprising:

a slider;

a screw rod having a screw thread and two opposite screw thread surfaces, said slider being mounted on said screw rod and adapted to be translated thereon by a power source;

first and second drivers secured for movement with said slider and respectively contacting said screw thread surfaces to rotate said screw rod when said slider is translated; and elastic elements respectively mounted between said first and second drivers and said slider for providing an elastic, buffering action between said screw rod and said drivers.

20. A lead transmission mechanism according to claim 19, wherein said first and second drivers respectively engage said screw thread surfaces.

* * * * *